US011002018B2

(12) United States Patent
Pilja

(10) Patent No.: US 11,002,018 B2
(45) Date of Patent: May 11, 2021

(54) NEWEL POST SUPPORT

(71) Applicant: Maks Products Pty Ltd, Beverley (AU)

(72) Inventor: Milan Pilja, Woodville West (AU)

(73) Assignee: Maks Products Pty Ltd, Beverley (AU)

( * ) Notice: Subject to any disclaimer, the term of this patent is extended or adjusted under 35 U.S.C. 154(b) by 487 days.

(21) Appl. No.: 15/941,878

(22) Filed: Mar. 30, 2018

(65) Prior Publication Data

US 2018/0283011 A1 Oct. 4, 2018

(30) Foreign Application Priority Data

Mar. 31, 2017 (AU) ..... 2017901185

(51) Int. Cl.
*E04F 11/18* (2006.01)
*E04H 12/22* (2006.01)

(52) U.S. Cl.
CPC ..... *E04F 11/1812* (2013.01); *E04H 12/2261* (2013.01)

(58) Field of Classification Search
CPC ... E04C 5/125; E04F 11/1812; E04F 11/1814; E04H 12/2261; E04H 17/22; F16B 9/026;
(Continued)

(56) References Cited

U.S. PATENT DOCUMENTS

D20,681 S 4/1891 Hutchins
3,572,511 A * 3/1971 Triplett ..... F16B 9/026 211/105.6

(Continued)

FOREIGN PATENT DOCUMENTS

AU 2009100469 A4 6/2009
AU 2005244596 C1 5/2010

(Continued)

OTHER PUBLICATIONS

Pilja, "XT Post Anchor 17.800," Sep. 20, 2017, URL=http://zipbolt.com.au/author/milan/, download date Mar. 26, 2018, 2 pages.

(Continued)

*Primary Examiner* — Josh Skroupa
(74) *Attorney, Agent, or Firm* — Seed IP Law Group LLP

(57) ABSTRACT

A support for the lower end of a newel post, comprising: a screw having a first screw thread at one end portion, a second screw thread at the other end portion and a third screw thread at an intermediate position along the screw; and a base plate having a centrally located threaded hole and auxiliary holes arranged around the periphery of the base plate; wherein the first screw thread is for engaging within a substrate for the newel post; the third screw thread is adapted to threadedly engage with the centrally located threaded hole to retain the base plate on the screw so that the base plate abuts the surface of the substrate engaged by the first screw thread; the other end portion of said screw is adapted to extend through a longitudinal passage in the lower end of the newel post and to terminate within an intersecting transverse opening spaced upwardly from the lower end of the newel post so that a nut screwed onto the second screw thread can apply a loading to the newel post to clamp the lower end against the base plate; and the auxiliary holes are for co-operating with auxiliary screws to fasten the base plate to the substrate.

7 Claims, 20 Drawing Sheets

(58) Field of Classification Search
CPC ..... F16B 9/052; F16B 9/058; F16B 25/0057; F16B 25/0063; F16B 25/0068
USPC ..... 256/65.14; 411/413
See application file for complete search history.

(56) References Cited

U.S. PATENT DOCUMENTS

| | | | | |
|---|---|---|---|---|
| 3,682,507 | A * | 8/1972 | Waud | F16B 25/0063 411/413 |
| 4,681,496 | A * | 7/1987 | Fasolino | F16B 19/05 411/361 |
| 5,095,668 | A | 3/1992 | O'Brien et al. | |
| 5,309,687 | A | 5/1994 | Walston | |
| 5,771,646 | A | 6/1998 | DeSouza | |
| 6,015,138 | A | 1/2000 | Kohlberger et al. | |
| 6,141,928 | A | 11/2000 | Platt | |
| 6,290,212 | B1 | 9/2001 | Bartel | |
| 6,715,242 | B1 | 4/2004 | Green et al. | |
| 6,718,710 | B2 * | 4/2004 | Platt | E04F 11/1814 52/296 |
| 7,048,462 | B2 | 5/2006 | Lanphier | |
| 7,421,824 | B1 | 9/2008 | Green | |
| 7,677,522 | B2 | 3/2010 | Bakos | |
| D629,678 | S | 12/2010 | Norton et al. | |
| D637,894 | S | 5/2011 | Maurer | |
| 8,162,561 | B2 * | 4/2012 | Pilja | F16B 5/0092 403/408.1 |
| D667,297 | S | 9/2012 | McLaughlin | |
| D671,397 | S | 11/2012 | McLaughlin | |
| 9,138,812 | B2 * | 9/2015 | Stalemark | E04H 12/2261 |
| 9,163,654 | B2 * | 10/2015 | Barenski, Jr. | F16B 25/0063 |
| 9,169,662 | B1 * | 10/2015 | Kim | E04C 5/125 |
| 9,249,817 | B2 * | 2/2016 | Imai | F16B 9/026 |
| D754,880 | S | 4/2016 | Reusing | |
| D806,904 | S | 1/2018 | DeBellis | |
| 9,863,114 | B2 | 1/2018 | Kaufman et al. | |
| 9,976,298 | B2 * | 5/2018 | Bergman | E04F 11/1812 |
| 2014/0356076 | A1 | 12/2014 | Hale et al. | |
| 2015/0218824 | A1 * | 8/2015 | Schaefer | F16B 9/026 52/704 |

FOREIGN PATENT DOCUMENTS

| | | | | |
|---|---|---|---|---|
| DE | 9211653 | U1 * | 11/1992 | E04H 12/2261 |
| DE | 202011101436 | U1 * | 10/2011 | F16B 25/0063 |
| EP | 000234828 | | 12/2004 | |
| GB | 3024510 | | 7/2006 | |
| JP | D1098935 | | 1/2001 | |
| JP | D1480447 | | 9/2013 | |
| JP | D1526856 | | 6/2015 | |

OTHER PUBLICATIONS

Zipbolt Online, "The XT Post Anchor 17.800," URL=http://zipboltonline.com.au/exterior-stair-hardware/the-xt-post-anchor-17-800.html, download date Mar. 26, 2018, 1 page.

* cited by examiner

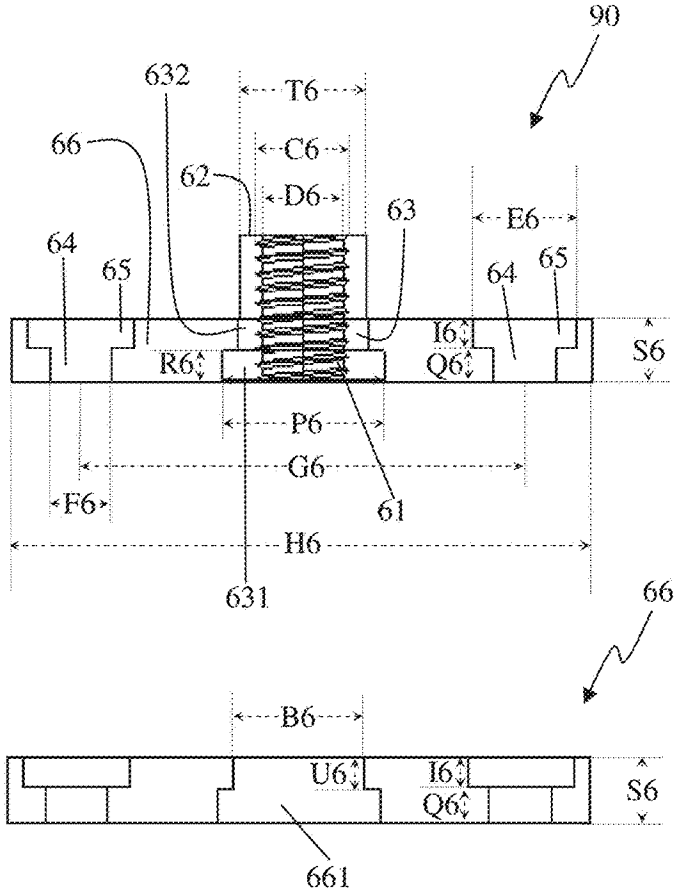
Figure 6B
Figure 6C
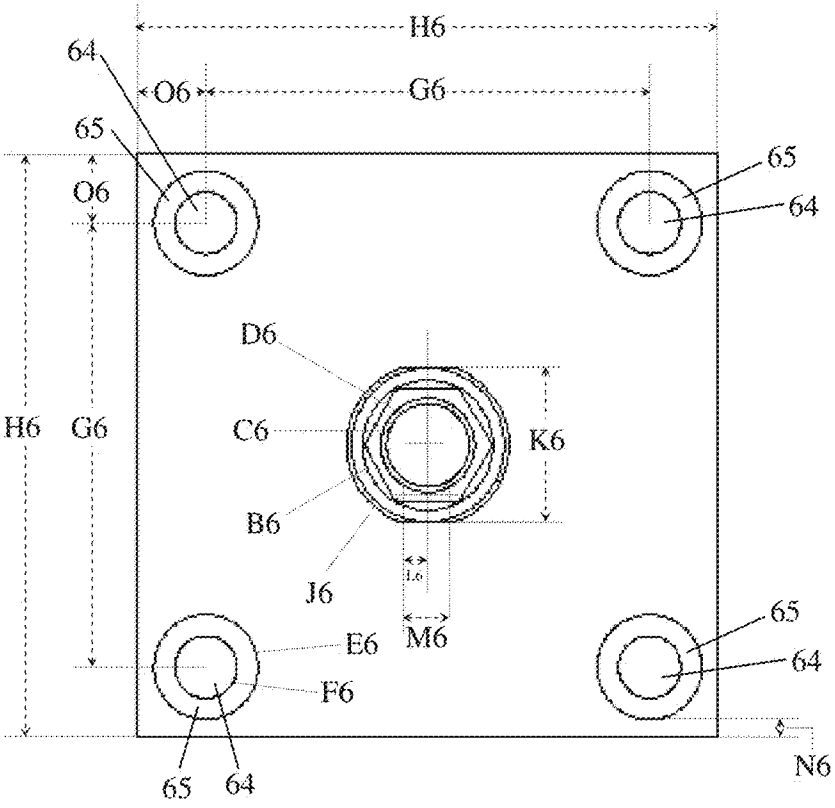
Figure 6A

NEWEL POST SUPPORT

CROSS-REFERENCE TO RELATED APPLICATION

This application claims priority to Australian Patent Application No. 2017901185, filed Mar. 31, 2017, the entire contents of which are hereby incorporated by reference.

BACKGROUND

Technical Field

This disclosure relates to newel post supports for securing a newel post to a substrate.

Description of the Related Art

Newel posts are the principal support posts which support a handrail. Handrails are usually provided along stair treads, landings, verandas, balconies and the like. Newel posts primarily serve a structural purpose and, as newel posts are pulled and pushed during use, they must be properly installed and secured.

Newel posts can be secured to a substrate using a specifically adapted fastener. It has been previously proposed to use a double-ended screw having a thread at its lower end for engaging the substrate and a thread at its upper end for engaging a nut to secure the newel post. However, it has been found that faults in the substrate near the screw, such as cracks, can lead to the fastener becoming loose and the newel post becoming insecure. Accordingly, it is desirable to provide a newel post support that can more robustly secure a post to a substrate.

BRIEF SUMMARY

This disclosure is concerned with the installation of a newel post in a structurally stable and secure manner. Simply securing a newel post to a floor surface using conventional fittings may not be adequate in terms of structural stability, and thus as regards safety.

The present disclosure provides a support for the lower end of a newel post, comprising:

- a screw having a first screw thread at one end portion, a second screw thread at the other end portion and a third screw thread at an intermediate position along the screw; and
- a base plate having a centrally located threaded hole and auxiliary holes arranged around the periphery of the base plate; wherein
- the first screw thread is for engaging within a substrate for the newel post;
- the third screw thread is adapted to threadedly engage with the centrally located threaded hole to retain the base plate on the screw so that the base plate abuts the surface of the substrate engaged by the first screw thread;
- the other end portion of said screw is adapted to extend through a longitudinal passage in the lower end of the newel post and to terminate within an intersecting transverse opening spaced upwardly from the lower end of the newel post so that a nut screwed onto the second screw thread can apply a loading to the newel post to clamp the lower end against the base plate; and
- the auxiliary holes are for co-operating with auxiliary screws to fasten the base plate to the substrate.

The base plate of the support of the present disclosure provides a way of engaging the screw with auxiliary screws. The auxiliary screws can supplement the central screw of the support to provide a robust anchor for the newel post. In the event that the engagement of the central screw with the substrate is compromised, the auxiliary screws can continue to secure the newel post to the substrate. Accordingly, the support of embodiments of the present invention may be used to anchor a newel post so that the newel post can be structurally adequate to withstand a prescribed load of a building standard. For example, the National Construction Code 2016 Building Code of Australia—Volume Two specifies that a barrier should be of strength and rigidity to withstand the foreseeable impact of people and, where appropriate, the static pressure of people pressing against it.

In some embodiments, the base plate comprises a central spigot through which the centrally located threaded hole passes. The spigot may include at least one pair of diametrically opposed flat faces adapted to being engaged by a tool to tighten the threaded engagement between the centrally located threaded hole and the third screw thread. For example, the spigot may be hexagonal, with three pairs of diametrically opposed flat surfaces for a tool to engage.

The present disclosure further provides a kit comprising the screw and the base plate of the support for the lower end of a newel post.

The term "substrate" should be interpreted as any layer on which a newel post is to be connected, including a floor which is readily visible and to which an installed newel post appears to interface. Such a substrate may include a raised step, decking or other generally planar platform.

In some embodiments, the support of the present disclosure is particularly adapted to securing newel posts to external substrates. In some other embodiments, the support of the present disclosure is particularly adapted to securing newel posts to internal substrates.

Embodiments of the newel post support of the present disclosure are adapted to engage a substrate. Often the device will be engaging a horizontal substrate such as a floor with the newel post orientated to be perpendicular to the floor. It is to be understood that terms such as "upwardly," "upper" and "lower" and similar terms as used herein are relative terms in relation to the configuration of the support when engaging a horizontal substrate and supporting a vertical newel post. It is however to be understood that the mounting of the support is not limited to this arrangement. For example, in some embodiments a newel post may be mounted along a ramp, and in such embodiments the substrate will have a slope.

In embodiments where the substrate is not horizontal, the base plate may extend at an angle appropriate to support the newel post as required. The orientation of the screw relative to the base plate depends primarily on the orientation of the substrate to which the support is to be secured and the desired angle of the assembled newel post. An installed newel post normally extends in a substantially vertical direction, and so the screw preferably also extends in a substantially vertical orientation. In the majority of cases, the surface of the substrate will be generally horizontal, and as such it is preferred that the base plate extends generally perpendicular to the screw. More than one type of base plate may be available, with the centrally located threaded hole extending through the base plate at a range of angles to account for variations in a substrate surface, such as an incline.

In other embodiments where the substrate is uneven, or where the substrate is not horizontal, one or more spacers may be used to compensate for differences between the orientation of the substrate and the desired orientation of the base plate so that the newel post can be secured at the desired angle. The one or more spacers is secured in position by being clamped between the lower surface of the primary base plate and substrate. Thus, in some embodiments, the base palate comprises one or more removable spacers so that, when the third screw thread is threadedly engaged with the centrally located threaded hole to retain the plate on the screw, the one or more spacers of the plate abuts the surface of the substrate engaged by the first screw thread. Typically, the one or more spacers will be arranged so that one or more of the screw and auxiliary screws passes through the spacer to further secure it in position.

When installing a newel post using the support of the disclosure, the screw can be screwed into a hole drilled into the substrate, so that the first screw thread engages within the substrate. In some embodiments, the substrate includes a floor and the underlying support, such as a floor joist. Proper connection, in order to ensure that the posts are structurally secure, often requires the newel post to be connected to floor joists.

In some embodiments, the screw may be chemically bonded within a hole in the substrate so that the first screw thread engages within the substrate. Thus, a chemical anchoring adhesive can be used to fix the screw within the substrate.

In some embodiments, the substrate may include concrete or masonry, and chemically bonding the screw within the substrate may be used in those embodiments.

After the first screw thread is engaged within the substrate, the base plate is passed over the other end portion of the screw, and the centrally located threaded hole is threadedly engaged with the third screw thread so that the plate abuts the surface of the substrate engaged by the first screw thread. Thus, the base plate is screwed onto the screw to retain the plate on the screw.

It will be appreciated that the third thread is located relative to the first thread such that, when the first thread is engaged within the substrate, the base plate can threadedly engage the third thread such that the plate will abut the substrate. Often, the third thread is immediately adjacent the first thread.

After the base plate is engaged with the screw, the auxiliary screws will be inserted through the auxiliary holes and used to fasten the base plate to the substrate. Similarly to the first thread, each auxiliary screw may be screwed into a hole drilled into the substrate so that the auxiliary screw engages within the substrate. In some other embodiments, each auxiliary screw may be chemically bonded within a hole in the substrate so that the screw thread engages within the substrate. In some other embodiments, for each auxiliary screw, a plug, such as a Rawlplug, or an anchor may be inserted into the substrate, and the auxiliary screw is then screwed into the plug or anchor so that each auxiliary screw is engaged with the substrate via its respective plug or anchor. In some embodiments, a combination of methods may be used to engage the screws within the substrate.

Often each auxiliary screw is shorter in length than the first screw thread of the screw, so that the auxiliary screws do not engage as deeply within the substrate as the first screw thread. However, in some embodiments, the auxiliary screws may be the same length or longer than the first screw thread. The length of the auxiliary screw may be selected based upon the nature of the substrate.

In some embodiments, such as when the substrate is a wooden floor or deck, the first screw thread may be engaged within a floor joist, and each auxiliary screw may also be engaged within the joist. In some other embodiments, one or more of the auxiliary screws may be engaged within the floor and subfloor (if present), but not also a joist.

The auxiliary holes in the base plate are typically countersunk, counterbored or recessed so that the head of each auxiliary screw does not protrude above the upper surface of the plate. In this way, the flat horizontal face at the lower end of the newel post can readily abut the base plate when clamped against the plate. It will be appreciated that the dimensions and geometry of the countersunk, counterbored or recessed hole can be varied to suit different kinds of screw heads.

Alternatively, in some embodiments, the post may have a recess to accommodate the head of the auxiliary screw protruding above the upper surface of the plate.

After the base plate is fastened to the substrate, the upper end portion of the screw is inserted into a longitudinal passage drilled into the lower end of the newel post. The longitudinal blind passage formed in the lower end of the newel post intersects with the relatively larger transverse opening formed in the post a predetermined distance from the lower end of the newel post.

The intersection of the longitudinal passage and the transverse opening are such that a nut screwed onto the first screw thread can apply a loading to the newel post to clamp the lower end against the plate. In some embodiments, a washer and nut can be secured over the upper end of the bolt and tightened to secure the newel post in place.

It will be appreciated that the size and shape of the transverse opening will be such that the nut can be screwed onto the first screw thread. In some embodiments, the transverse opening is circular. In some embodiments, the transverse opening has a diameter of about 25 mm to about 50 mm, for example about 35 mm to about 45 mm, such as about 38 mm.

In some embodiments, the washer may be shaped so that its surface substantially conforms to the surface at the intersection of the longitudinal passage and the transverse opening. The washer may also be shaped so as to provide a substantially flat upper surface that can be engaged by the nut.

In some embodiments, the nut may be a geared nut. Suitable geared nuts may include a gear assembly having rotatable first and second gears members operatively connected with each other, in a substantially perpendicular arrangement, the first gear member having a tool engaging aperture thereon, the second gear member having an aperture with an internal thread to receive the second screw thread therein. For example, a suitable geared nut may be a first clamping member as described in Australian Innovation Patent No. 2009/100469. By way of further example, a suitable geared nut may be a joiner as described in Australian Patent No. 2005244596.

In some embodiments, the lower surface of the geared nut is shaped so that it substantially conforms to the surface at the intersection of the longitudinal passage and the transverse opening.

By having the lower surface of the geared nut or the washer conform to the shape of the intersection, the surface area over which the loading to the newel post is applied may be increased. This may facilitate more effectively clamping the lower end of the newel post against the plate. In particular, by distributing the load over a greater surface area, it can be possible to decrease the likelihood of crushing or indenting the wood of the newel post with the lower surface of the nut through application of the clamping force.

Indentation or crushing of the wood of the newel post around the nut can, over time, cause the connection between the support and the newel post to loosen, affecting the security of the mounting. This may be of particular concern when the newel post is made of a soft wood.

In some embodiments, to further reduce the chance of indentation or crushing as a result of the clamping load, a geared nut with a lower surface conforming to the surface of the intersection may be used in combination with a curved washer that also conforms to the intersection of the longitudinal passage and the transverse opening. The curved washer further increases the surface area over which the load is applied so as to reduce the likelihood of the wood being indented or crushed by the clamping force. The curved washer may include a slot sized to accommodate the upper end of the screw. By using a slot instead of an aperture, it may be possible to position the geared nut onto this screw and then slide the curved washer into position between the lower surface of the geared nut and the surface of the intersection of the longitudinal passage and the transverse opening, prior to fully screwing the geared nut down onto the second screw thread.

After the newel post is clamped against the plate, a plug can then be inserted to close the transverse hole in the newel post.

The length and type of thread for the first screw thread can be selected based upon the type of substrate. The first thread of the screw is typically a coarse thread. In some embodiments, the thread may be of the type found in large wood screws, such as lag screws (US) or coach screws. In some embodiments, the first screw thread has 4 threads per inch (TPI) to 8 TPI, for example about 6 TPI. Threads per inch is determined using the distance between the peaks of the threads. Thus, in some embodiments, the distance between peaks of the first thread is about 6.35 mm to about 3.175 mm, for example about 4.23 mm.

The length of the first screw thread may be from about 120 mm to about 160 mm, for example from 130 mm to 150 mm, such as about 140 mm.

The major diameter of the first screw thread may be about 12 mm to about 15 mm, for example about 13 mm to about 14 mm, such as around 13.5 mm. The minor diameter of the first screw thread may be 9 mm to about 12 mm, for example about 10 mm to about 11 mm, such as around 10.5 mm.

In some embodiments, the third screw thread has 10 TPI to 14 TPI, for example about 12 TPI. Thus, in some embodiments, the distance between peaks of the third thread is about 2.54 mm to about 1.81 mm, for example about 2.12 mm.

The length of the third screw thread may be from about 15 mm to about 30 mm, for example from 20 mm to 25 mm, such as about 22 mm.

The major diameter of the third screw thread may be larger than the major diameter of the first screw thread. In some embodiments, the major diameter of the third screw thread may be about 13 mm to about 16 mm, for example about 13.5 mm to about 14.5 mm, such as about 14.2 mm or 14.14 mm. The minor diameter of the third screw thread may be 11 mm to about 14 mm, for example about 12 mm to about 13 mm, such as around 12.3 mm.

The second screw thread and the shank of the screw between the third screw thread and the second screw thread will have diameters smaller than the third screw thread so that the second screw thread and the shank can pass through the centrally located hole of the base plate.

In some embodiments, the shank may have a diameter of less than about 12 mm. In some embodiments, the shank has a diameter between about 8.5 mm and about 11.5 mm, for example about 9.85 mm.

The shank may include a section having at least one pair of diametrically opposed flat faces for a tool to aid in engaging the screw within the substrate. In some embodiments, the section is a hexagonal section with three pairs of diametrically opposed flat faces for a tool to engage. In some embodiments, the distance between the opposed faces may be about 10 mm. In some embodiments, the section may be about 20 mm long.

In some embodiments, there may be a smooth circular section of shank between the section having diametrically opposed flat surfaces and the third screw thread. This smooth circular section may be about 50 mm long.

In some embodiments, the screw may have a smooth circular section of shank between the section having diametrically opposed flat surfaces and the second screw thread. In some embodiments, this smooth circular section of shank may be about 20 mm to about 25 mm long, for example about 23 mm long.

In some embodiments, the diameters of the sections of shank on either side of the section having diametrically opposed flat surfaces may be the same or different. In some embodiments, the diameter of the smooth circular section of shank between the section having diametrically opposed flat surfaces and the second screw thread may be smaller than the smooth circular section of shank between the section having diametrically opposed flat surfaces and the third screw thread.

The length and type of thread for the second screw thread can be selected based upon the type of nut to be used. As noted above, in some embodiments a geared nut is used, and suitable geared nuts may include a gear assembly having rotatable first and second gears members operatively connected with each other, in a substantially perpendicular arrangement, the first gear member having a tool engaging aperture thereon, the second gear member having an aperture with an internal thread to receive the second screw thread therein. In some embodiments, so that the first gear member having a tool engaging aperture thereon can be rotated in the tightening- and loosening-directions for standard right-hand threads, the second gear member has an internal left-hand thread. Accordingly, in these embodiments, the second screw thread will be a complementary external left-hand thread.

In some other embodiments, such as when an ungeared nut is to be used, the second screw thread selected is a right-hand thread.

In some embodiments, the second screw thread has 18 TPI to 22 TPI, for example about 20 TPI. Thus, in some embodiments, the distance between peaks of the third thread is about 1.41 mm to about 1.15 mm, for example about 1.25 mm.

The length of the second screw thread may be from about 15 mm to about 30 mm, for example from about 20 mm to about 25 mm, such as about 22 mm. In some embodiments, the major diameter of the second screw thread may be about 9.5 mm to about 10 mm, for example about 9.75 mm to about 9.95 mm, such as about 9.85 mm.

It will be appreciated that a newel post may require adaptation before installation, depending on whether the post is specifically designed for use with the support. Where a conventional newel post is used, such adaptation may include the forming the longitudinal passage and intersecting transverse opening in the post.

In some embodiments, the base plate may be oversized relative to the lower end of the lower end of the post, so as to provide greater support. The oversized base plate can provide a larger footprint, and may be more difficult to lever out of the substrate than a smaller base plate.

While newel posts primarily serve a structural purpose, the posts often have a decorative appearance. To this end, in some embodiments, the base plate may be oversized relative to the lower end of the lower end of the post so as to provide a feature of ornamentality. However, typically, the base plate will be adapted so that it is not visible when the newel post is installed and finished.

The base plate may be smaller than the lower end of the newel post. In some embodiments, a recess may be formed in the lower end of the newel post so that it is configured to accommodate the base plate of the support. In this way, the base plate will not be visible once the newel post is installed.

In some embodiments, the base plate is slightly undersized relative to the footprint of the lower end of the newel post, so that after installation a veneer can be applied to the base plate to disguise it. The dimension of the base plate and the thickness of the veneer may be selected so that once the veneer is applied to the base plate it provides a substantially uninterrupted surface with the side(s) of the newel post.

The base plate may be substantially the same size and shape as the outer profile of the post, so that when the lower end of the post is clamped against the plate, the respective sides are adjacent and flush. Thus, the base plate may provide a substantially uninterrupted surface with the side(s) of the newel post when clamped against the plate. In these embodiments, a coating may be applied to the installed newel post, including the visible parts of the base plate, so that the base plate cannot be seen after application of the coating.

The base plate may be provided in a variety of shapes including, but not limited to, a circular plate, a rectangular plate and a square plate. Typically, the base plate will conform to the outer profile of the lower end of the newel post. Newel posts are available in many forms, but the lower part of the posts typically has a square outer profile. As such, a generally square base plate may be desirable in order to provide a stable platform for the post.

In some embodiments, each side of the plate may be up to, or greater than, 120 mm. In some embodiments, each side of the plate may be about 80 mm to about 120 mm long, or, for example about 80 mm to about 100 mm, or, for example, about 90 mm long.

The auxiliary holes are arranged around the periphery of the plate. In some embodiments, the auxiliary holes may be arranged so that a hole is formed in each corner of the plate. For example, when the plate is substantially square or rectangular, four auxiliary holes may be provided in the plate with one hole in each corner.

In some embodiments, such as when the plate is circular, auxiliary holes may be equidistantly spaced around the periphery of the plate.

In some embodiments, an auxiliary hole may be formed as an intermediate point of the periphery between two corners of the plate.

Typically, each auxiliary hole will have the same diameter. In addition, each auxiliary hole often has a diameter smaller than the centrally located threaded hole. In some embodiments, the diameter of the auxiliary holes is from about 8 mm to about 11 mm, for example about 9 mm to about 10 mm, such as about 9.5 mm.

It will be appreciated that the centrally located threaded hole will have suitable dimensions such that the hole is adapted to threadedly engage with the third screw thread of the screw.

In some embodiments, the base plate may include a central spigot through which the centrally located threaded hole passes.

The spigot may include at least one pair of diametrically opposed flat surfaces for a tool to engage to aid in screwing the base plate on to the third screw thread so that it abuts the surface of the substrate. In some embodiments, the spigot is hexagonal, with three pairs of diametrically opposed flat surfaces for a tool to engage. In some embodiments, the distance between the opposed faces may be about 17 mm. In some embodiments, the spigot may be about 15 mm to about 20 mm long.

In some embodiments, the plate may be up to 10 mm thick, for example about 9 mm thick.

BRIEF DESCRIPTION OF THE SEVERAL VIEWS OF THE DRAWINGS

Various embodiments of the invention will now be described, by way of example only, with reference to the accompanying drawings in which:

FIG. 6A shows a top view of a second embodiment of a base plate for a support of the present invention;

FIG. 6B shows a side view of the second embodiment of the base plate for a support of the present invention;

FIG. 6C shows a side view of the main plate of the second embodiment of the base plate for a support of the present invention;

DETAILED DESCRIPTION

Figure 1A:
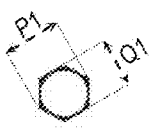
FIG. 1A shows a cross-section view of part of the first embodiment of a screw for a support of the present invention.

In the following detailed description, reference is made to accompanying drawings which form a part of the detailed description. The illustrative embodiments described in the detailed description, depicted in the drawings and defined in the claims, are not intended to be limiting. Other embodiments may be utilized and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

As used herein, the singular forms "a," "an," and "the" designate both the singular and the plural, unless expressly stated to designate the singular only.

The term "about" and the use of ranges in general, whether or not qualified by the term about, means that the number comprehended is not limited to the exact number set forth herein, and is intended to refer to ranges substantially within the quoted range while not departing from the scope of the invention. As used herein, "about" will be understood by persons of ordinary skill in the art and will vary to some extent on the context in which it is used. If there are uses of the term which are not clear to persons of ordinary skill in the art given the context in which it is used, "about" will mean up to plus or minus 10% of the particular term.

In addition, where dimensions are described herein, it will be appreciated that plus or minus (±) typical manufacturing tolerances are applicable to those values. As appreciated by those in the art, manufacturing tolerances may be determined to achieve a desired mean and standard deviation of manufactured components in relation to the ideal component profile.

Figure 1:
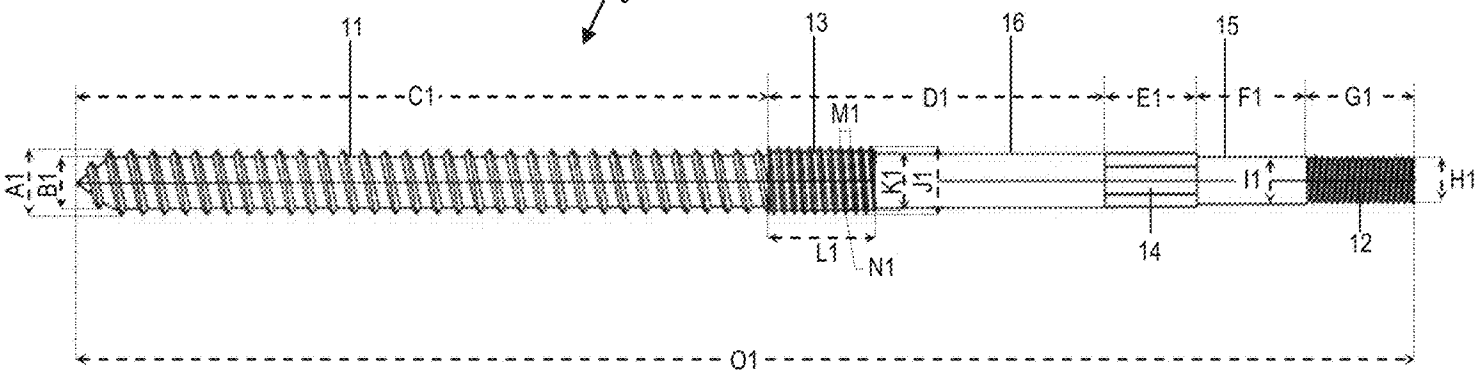
FIG. 1 shows a side view of a first embodiment of a screw for a support of the present invention.

FIG. 1 shows a first embodiment of a screw 10 having a first screw thread 11 at one end portion, a second screw thread 12 at the other end portion and a third screw thread 13 at an intermediate position along the screw 10.

The screw 10 is 273.8 mm long (dimension O1), with the first screw thread 11 being 140 mm long (dimension C1), the second screw thread 12 being 22 mm long (dimension G1) and the third screw thread 13 being 22 mm long (dimension L1). However, in an alternative embodiment, the first screw thread 11 can be 130 mm long (dimension C1).

The first screw thread 11 has 6 TPI, a major diameter of 13.5 mm (dimension A1) and a minor diameter of 10.5 mm (dimension B1).

In this embodiment, the screw 10 is intended for use with a geared nut (not shown) and, consequently, the second screw thread 12 is a left-hand thread. In some other embodiments, such as when the screw 10 is for use with an ungeared nut, the second screw thread will be a right-hand thread. The second screw thread 12 has about 20 TPI, with distance between peaks of 1.25 mm, and a major diameter of 9.85 mm (dimension HD.

The third screw thread 13 has about 12 TPI, a major diameter of 14.2 mm (dimension K1) and a minor diameter of 12.3 mm (dimension J1). Thus, the third screw thread 13 is 9/16 inch thread (dimension N1) with 12 TPI. The distance between peaks of the thread of the third screw thread 13 is 2.12 mm (dimension M1). In some other embodiments, the third screw thread 13 has a major diameter of 14.14 mm (dimension K1).

The screw 10 includes a hexagonal section 14 that can be engaged by a tool, such as a wrench, spanner or shifter, to rotate the screw to engage the first screw thread 11 within the substrate. The cross-section of the hexagonal section 14 is shown in FIG. 1A. The distance between the opposed faces of the hexagonal section 14 is 10 mm (dimension Q1) and the distance between the opposed vertices is 11.3 mm (dimension P1). The hexagonal section 14 is 19 mm long (dimension E1).

Between the hexagonal section 14 and the second screw thread 12 there is a smooth circular section of shank 15 that is 9.9 mm in diameter (dimension I1). There is a second smooth circular section 16 between the third screw thread 13 and the hexagonal section 14.

Dimension D1 of the screw 10 is 69.8 mm. However, in an alternative embodiment, dimension D1 of the screw 10 is 79.8 mm.

Dimension F1 of the screw is 23 mm.

Figure 2B:
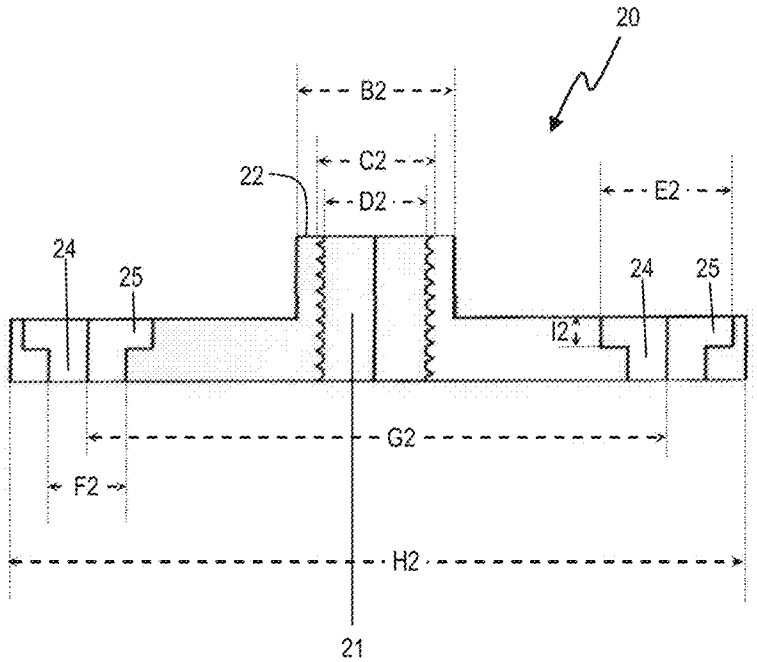
FIG. 2B shows a side view of the first embodiment of a base plate for a support of the present invention.
Figure 2A:
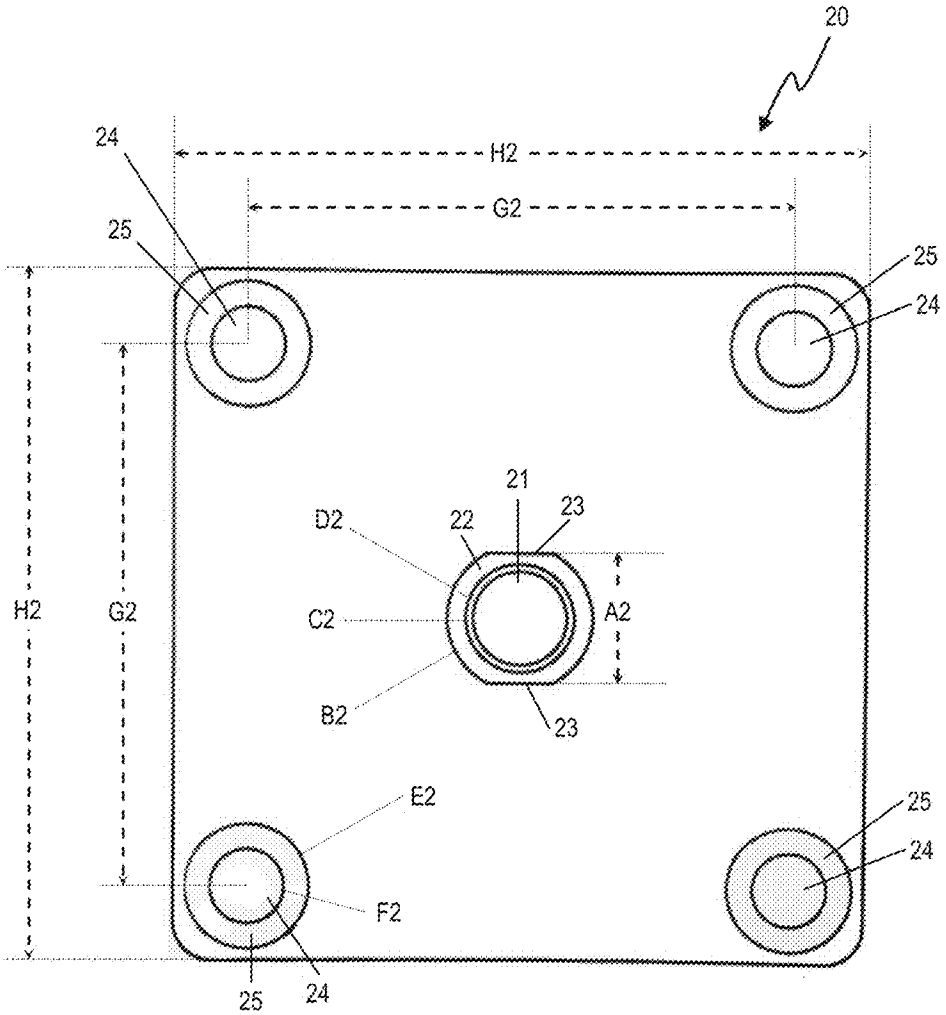
FIG. 2A shows a top view of a first embodiment of a base plate for a support of the present invention.

FIGS. 2A and 2B show views of a first embodiment of a substantially square base plate 20. The centrally located threaded hole 21 has 12 TPI, a major diameter of 14.2 mm (dimension C2) and a minor diameter of 12.3 mm (dimension D2). Thus, it is adapted to threadedly engage the third screw thread 13 of screw 10.

The base plate 20 includes a spigot 22 that generally has an external diameter of 19 mm (dimension B2). The spigot 22 includes a pair of diametrically opposed faces 23. The distance between faces 23 is 17 mm (dimension A2).

The four auxiliary holes 24 of the plate 20 each include counterbored sections 25. The diameter of the hole 24 is 9.5 mm (dimension F2), with the counterbored section having a depth of 4.5 mm (dimension 12) and a diameter of 16 mm (dimension E2). The distance between the centers of adjacent holes 24 is 70 mm (dimension G2). The sides of the base plate are 89 mm (dimension H2) with a radius of 5 mm at each corner.

Figure 3:
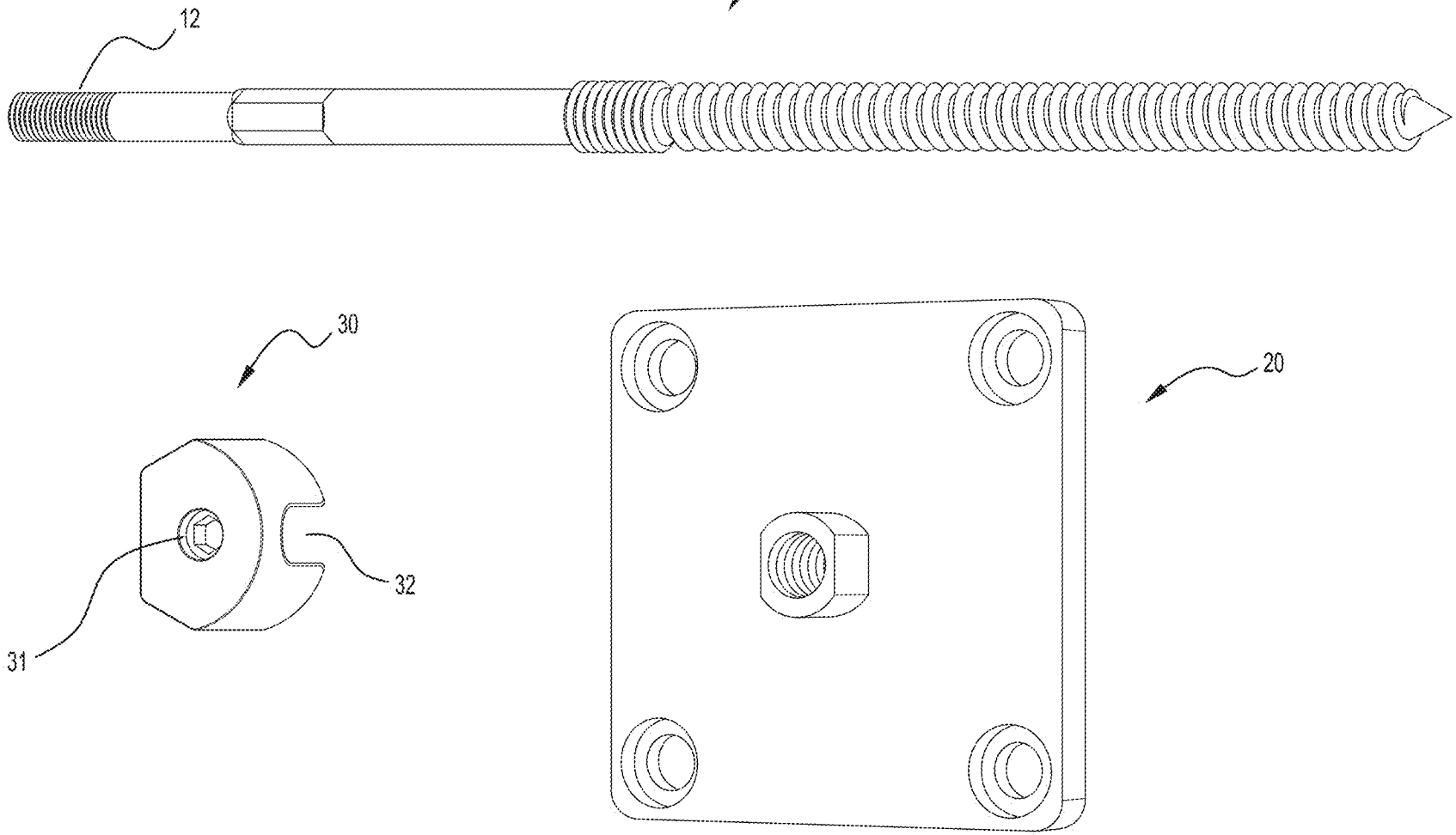
FIG. 3 shows a kit for a support according to an embodiment of the present invention.

FIG. 3 illustrates a kit including the screw 10, base plate 20 and a geared nut 30. The nut 30 has a tool engaging aperture 31 arranged perpendicular to an aperture (not shown) having an internal thread for threadedly engaging with the second screw thread 12. The nut 30 also includes a slot 32 to assist in locating the second screw thread 12 in the internally threaded aperture.

Figure 4A:
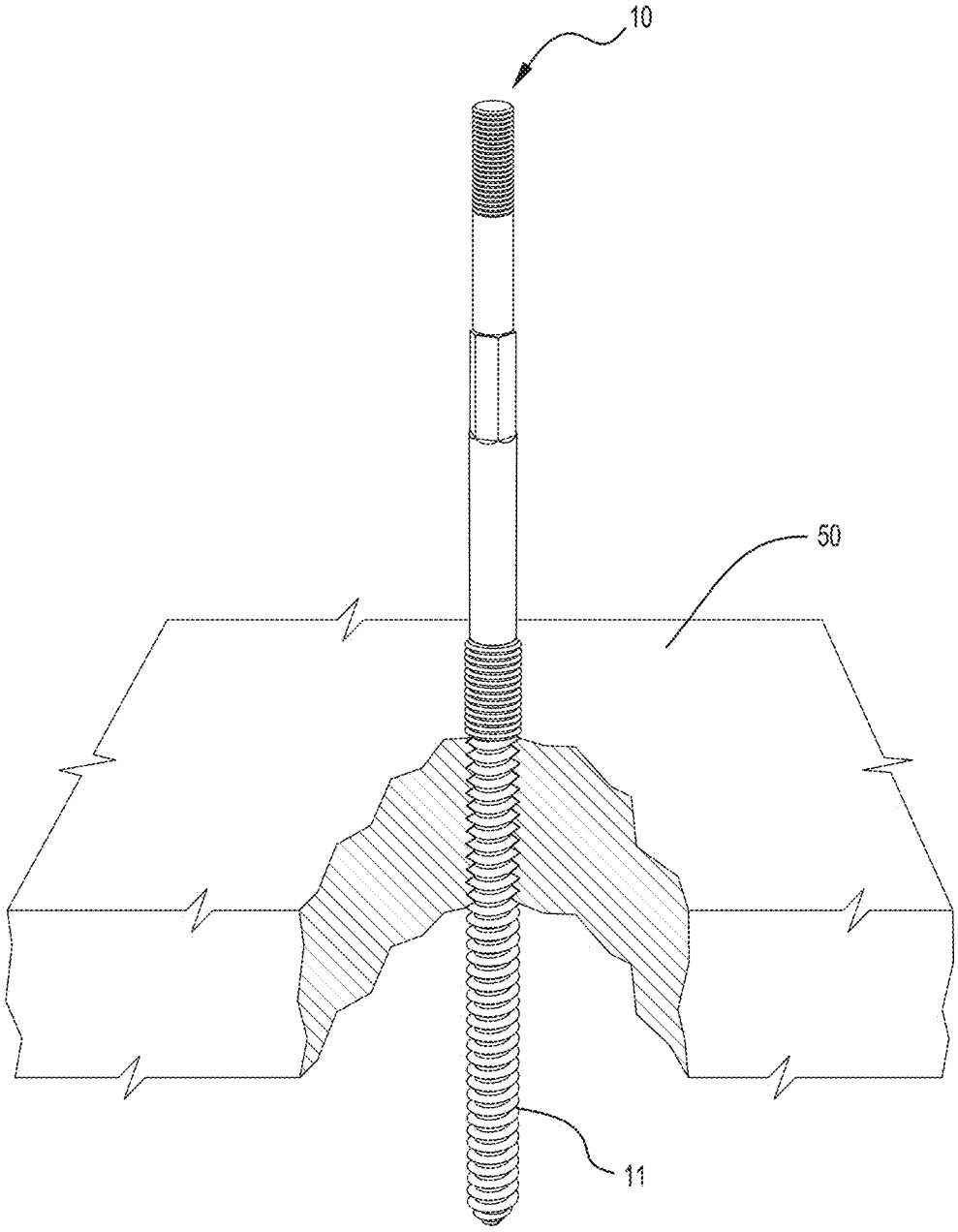
FIGS. 4A, 4B, 4C and 4D shows the steps of assembling a newel post using a support in accordance with an embodiment of the present invention.
Figure 4B:
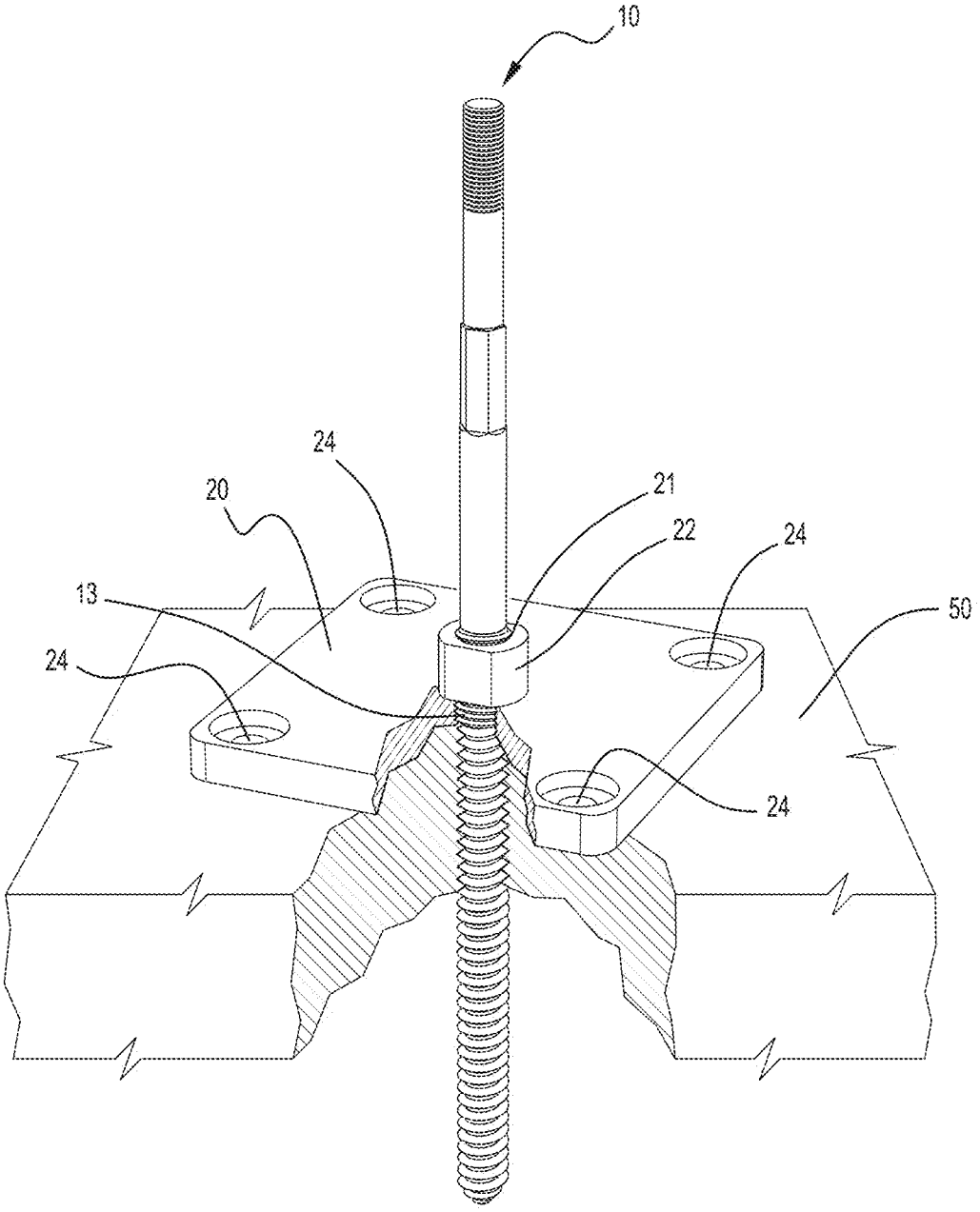
Figure 4C:
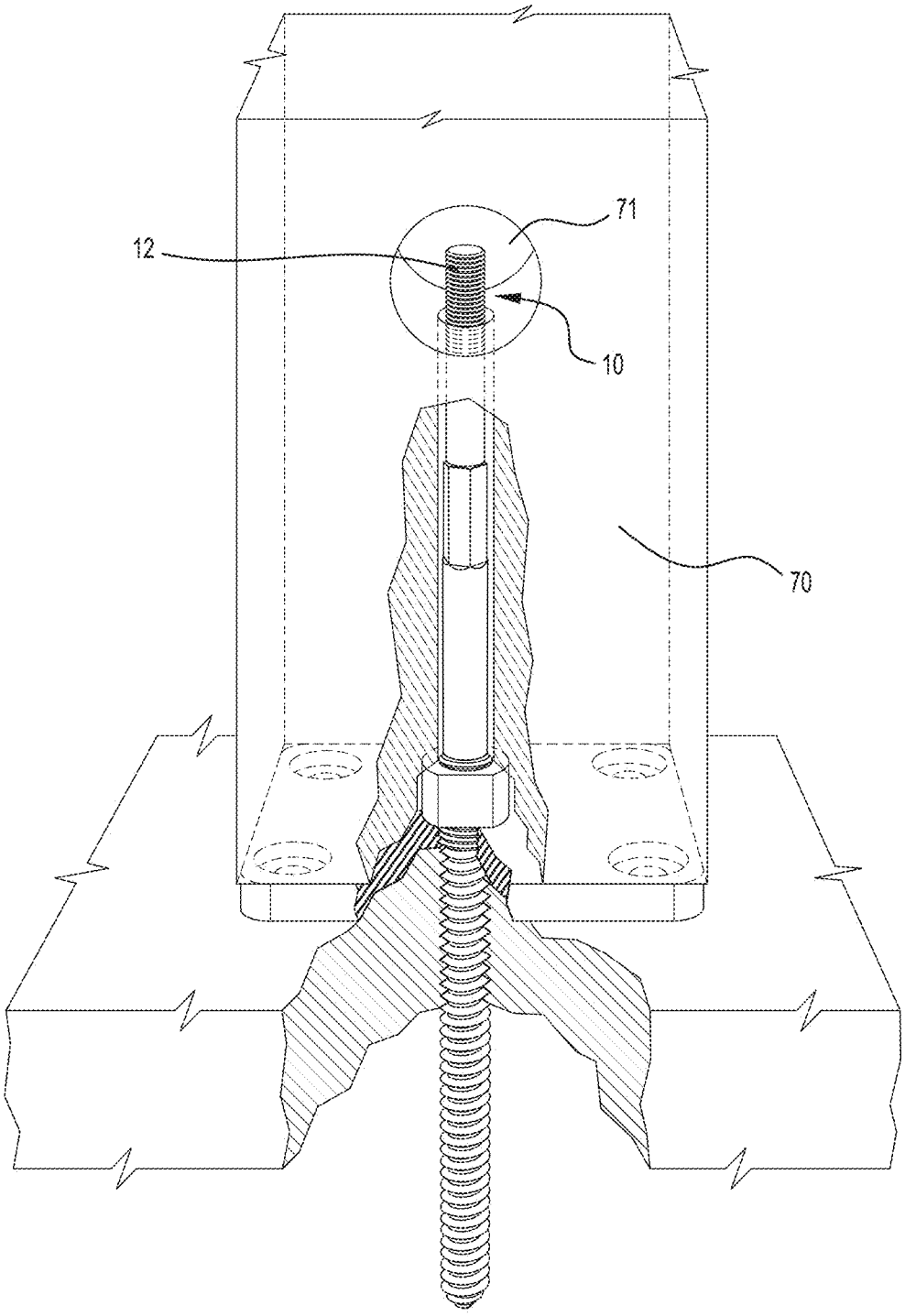

FIGS. 4A-4D illustrate the steps of the method for assembling a newel post using the support of an embodiment of the present invention. FIGS. 4A, 4B and 4C are partial cutaway views illustrating the passage of the screw 10 through the substrate 50, the base plate 20 and the newel post 70.

In FIG. 4A the first screw thread 11 of the screw 10 has been engaged within the substrate 50.

The centrally located threaded hole 21 of the base plate 20 is then engaged with the third screw thread 13 as shown in FIG. 4B. So as to firmly secure the screw 10, the spigot 22 can be engaged by a tool to screw down the plate 20 so that it firmly abuts the substrate 50.

Auxiliary screws (not shown) are then screwed into the substrate 50 through the auxiliary holes 24 to fasten the plate 20 to the substrate 50.

Once the base plate 20 is fastened to the substrate 50, the newel post 70 is positioned over the screw 10 so that the upper end portion of the screw 10 extends through a longitudinal passage in the lower end of the newel post 70, as shown in FIG. 4C. The upper end of the screw (i.e., the end with the second screw thread 12) terminates within an intersecting transverse opening 71 spaced upwardly from the lower end of the newel post 70.

Figure 4D:
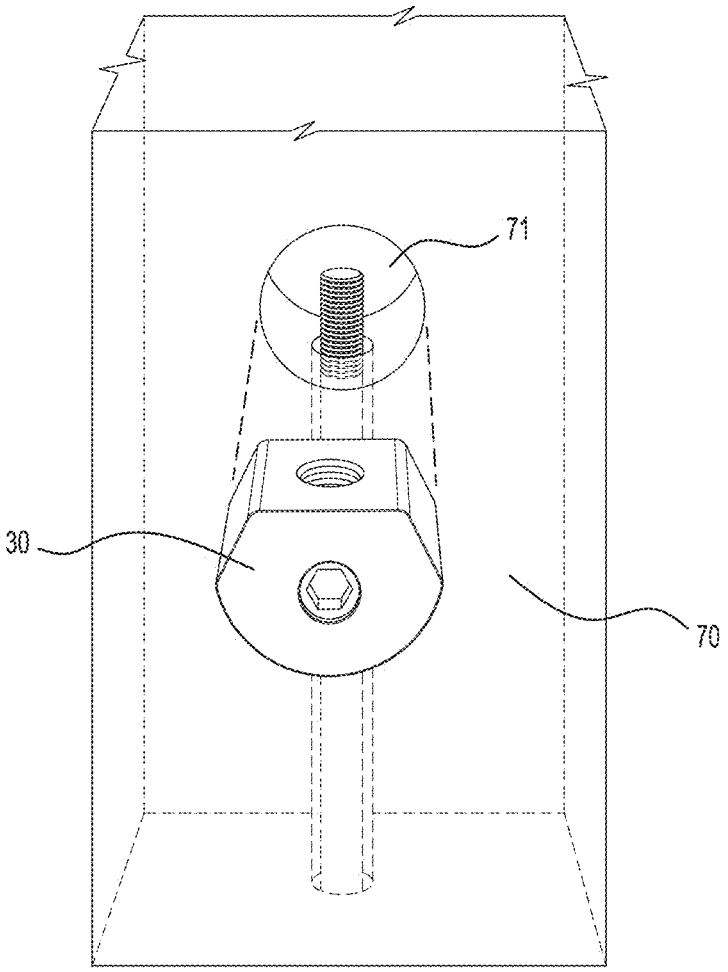

The nut 30 is then inserted into the intersecting transverse opening 71, as shown in FIG. 4D, and screwed onto the second screw thread 12 to apply a loading to the newel post 70 to clamp the lower end against the plate 20. After the newel post 70 is securely clamped to the plate 20, the opening 71 can be closed with a plug.

Figure 5:
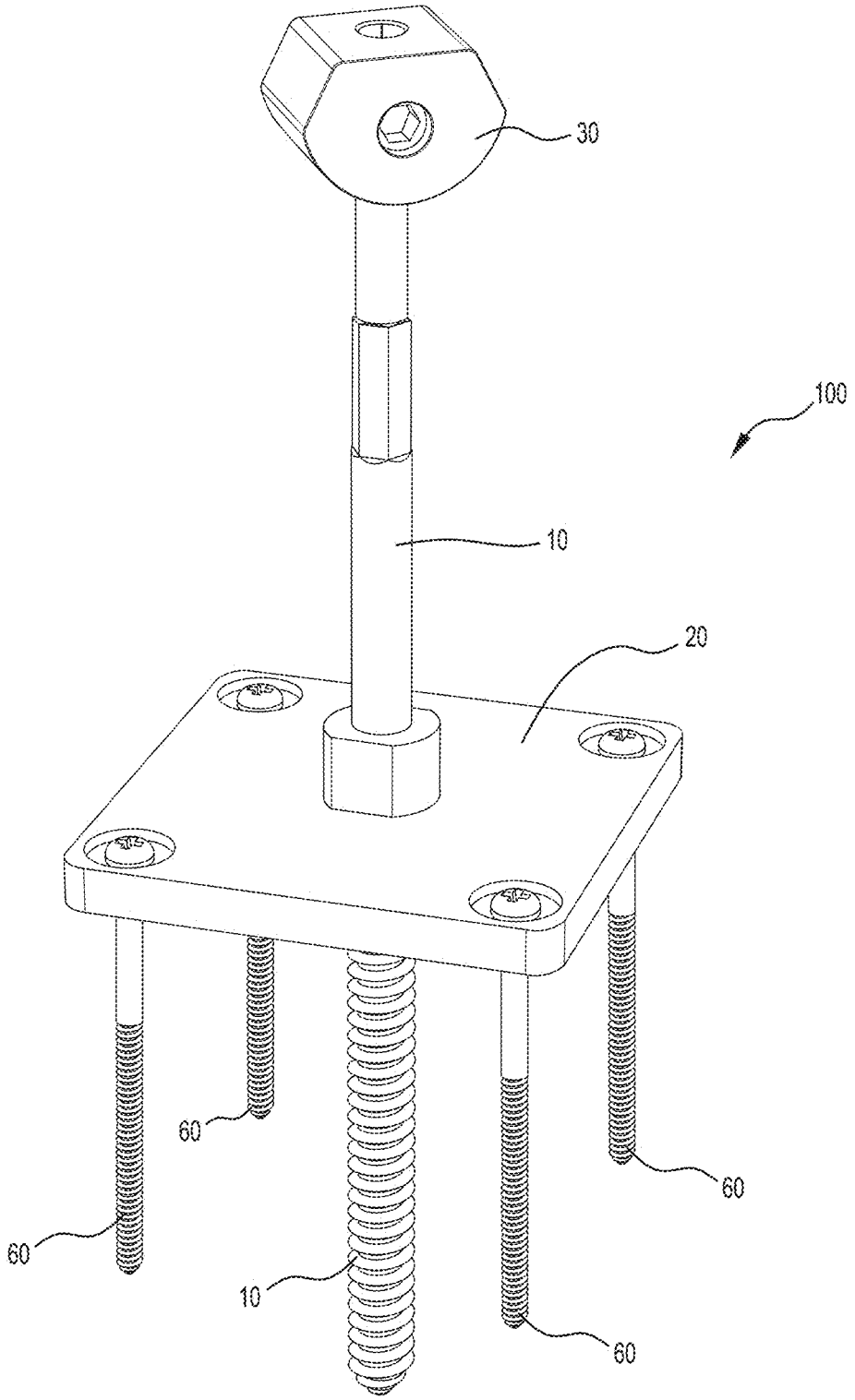
FIG. 5 shows an embodiment of a support of the present invention.

FIG. 5 shows an embodiment of the newel post support 100 that is not engaged with a substrate. The support 100 includes the screw 10, base plate 20, four auxiliary screws 60 and geared nut 30.

FIGS. 6A and 6B show views of a second embodiment of a substantially square base plate 90 that is intended to be finished with an epoxy coating before use. The dimensions of the base plate 90 described herein relate to the uncoated base plate. The centrally located threaded hole 61 has 12 TPI, a major diameter of 14.4 mm (dimension C6) and a minor diameter of 12.7 mm (dimension D6). Thus, it is adapted to threadedly engage the third screw thread 13 of screw 10.

The base plate 90 includes a spigot 62 that generally has an external diameter of 19 mm (dimension B2). The spigot 62 is hexagonal with three pairs of diametrically opposed faces 23. The distance between opposed vertices of the spigot 62 is 19.3 mm (dimension T6).

The spigot 62 is formed as part of a lug 63 separate from the main plate 66 of the base plate 90. The main plate 66 is illustrated by FIG. 6C. The lug 63 is designed to be force fit into a cavity 661 of the main plate 66. In some embodiments, the lug 63 is also welded so as to be fixed in position.

The lug 63 includes a lower portion 631 that is 5 mm high (dimension R6) and 25 mm across (dimension P6). An intermediate portion 632 of the lug 63 is designed to fit in the upper portion of the cavity 661 that has a diameter of 20 mm (dimension B6) and a height of 5 mm (dimension U6).

The four auxiliary holes 64 of the plate 90 each include counterbored sections 65. The diameter of the hole 64 is 9.5 mm (dimension F6), with the counterbored section 65 having depth of 4.5 mm (dimension I6) and a diameter of 16 mm (dimension E6). The depth of each hole 64, excluding the counterbored section 65, is 5.5 mm (dimension Q6). The distance between the centers of adjacent holes 64 is 68 mm (dimension G6). The sides of the base plate are 89 mm (dimension H6). Dimension O6 is 10.5 mm and dimension N6 is 2.5 mm.

The main plate 66 is 10 mm thick (dimension S6).

Dimension J6 is a diameter of 25 mm, and dimension K6 is 23.5 mm. Dimension M6 is 6.54 mm and dimension L6 is 3.27 mm.

Figure 7A:
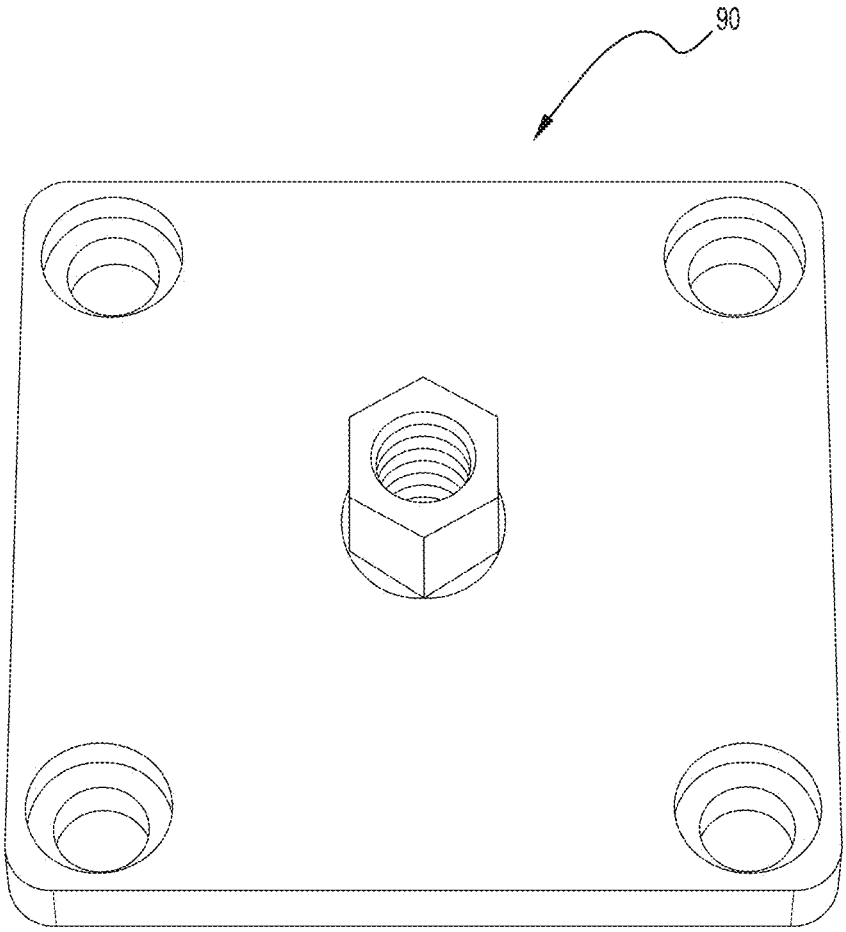
FIG. 7A shows a perspective view of the second embodiment of the base plate for a support of the present invention.
Figure 7B:
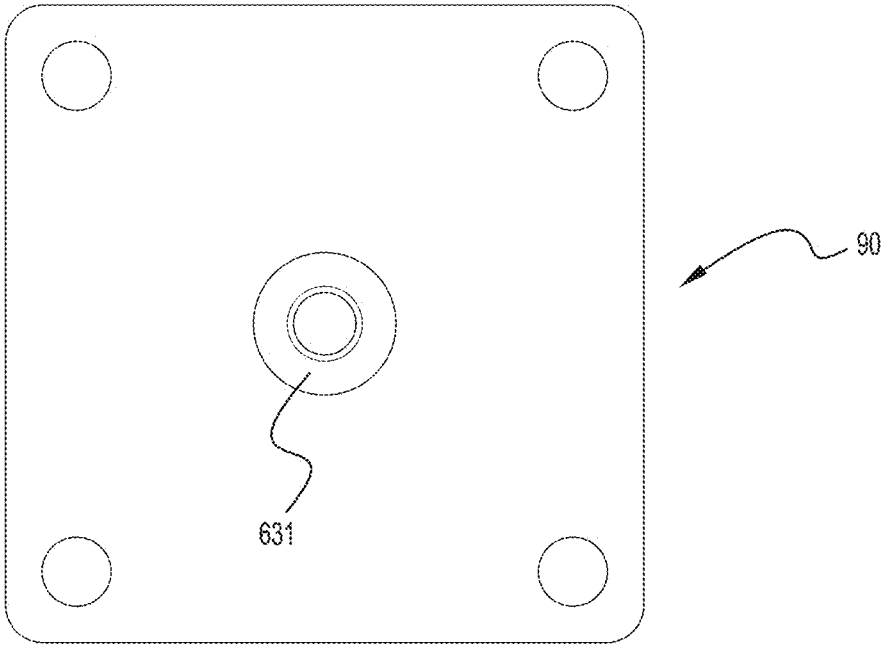
FIG. 7B shows a bottom view of the second embodiment of the base plate for a support of the present invention.
Figure 7C:
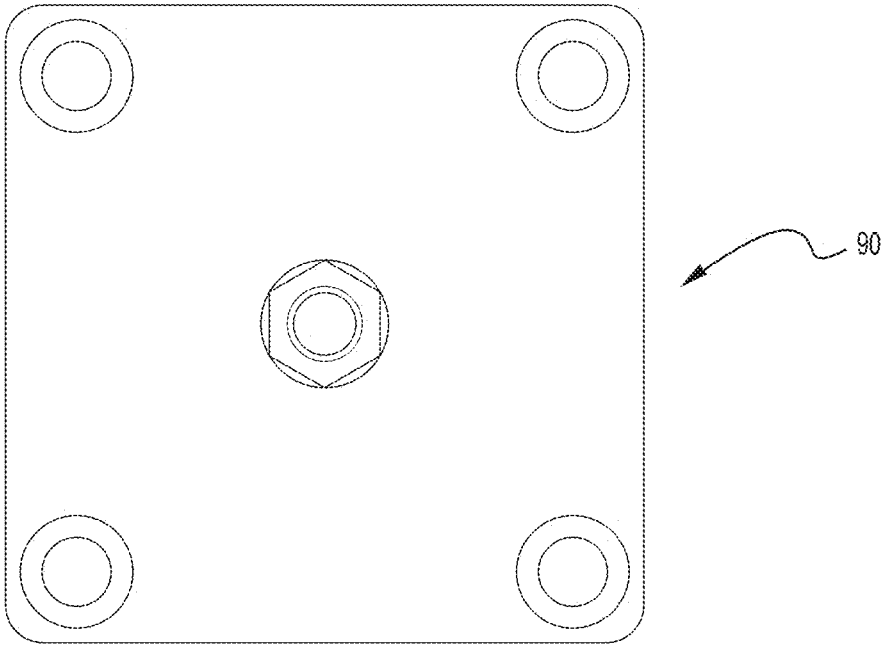
FIG. 7C shows a top view of the second embodiment of the base plate for a support of the present invention.

FIGS. 7A, 7B and 7C show further views of the second embodiment of the base plate 90, with FIGS. 7B and 7C showing bottom and top views of the base plate 90, respectively. In this embodiment, the lower portion 631 of the lug 63 can be seen in FIG. 7B.

Figure 7D:
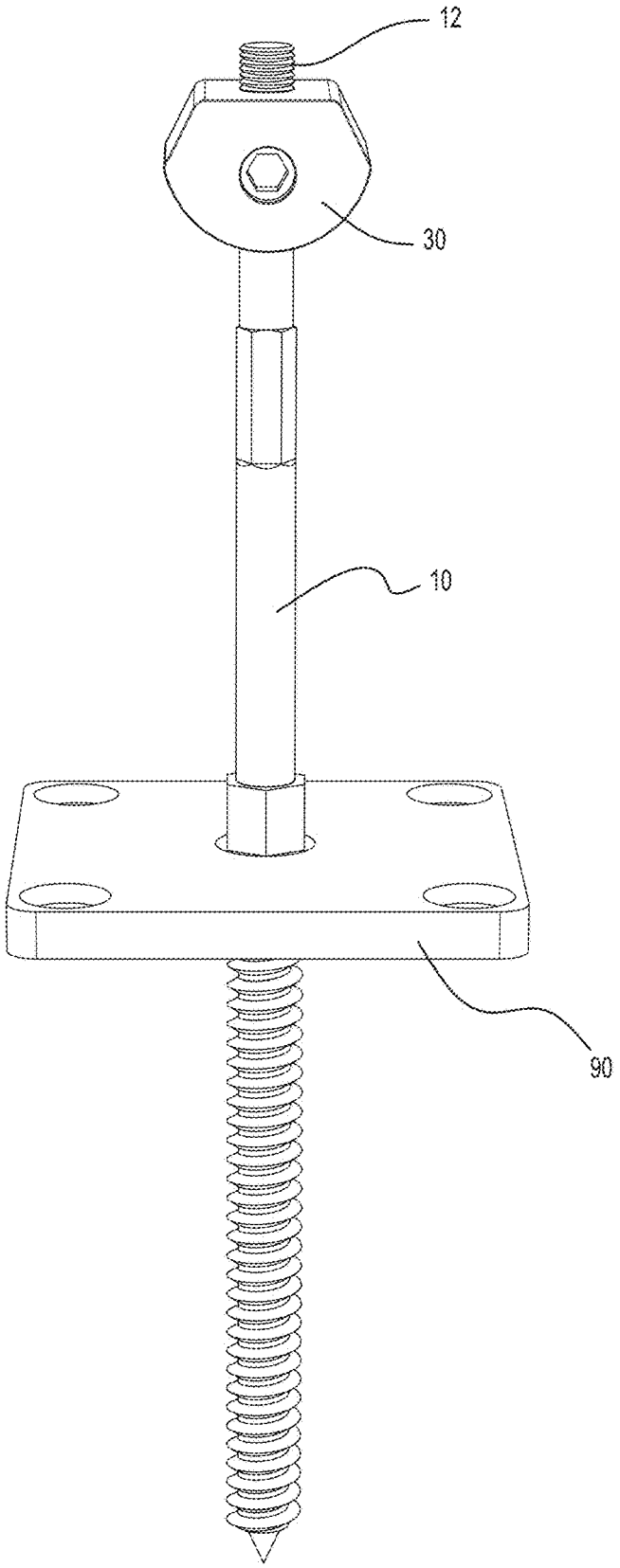
FIG. 7D shows a partially assembled second embodiment of a kit for a support of the present invention.

FIG. 7D illustrates the partially assembled newel post support with the base plate 90 engaged with the third screw thread (not shown) of the screw 10 and the geared nut 30 screwed onto the second screw thread 12.

Figure 7E:
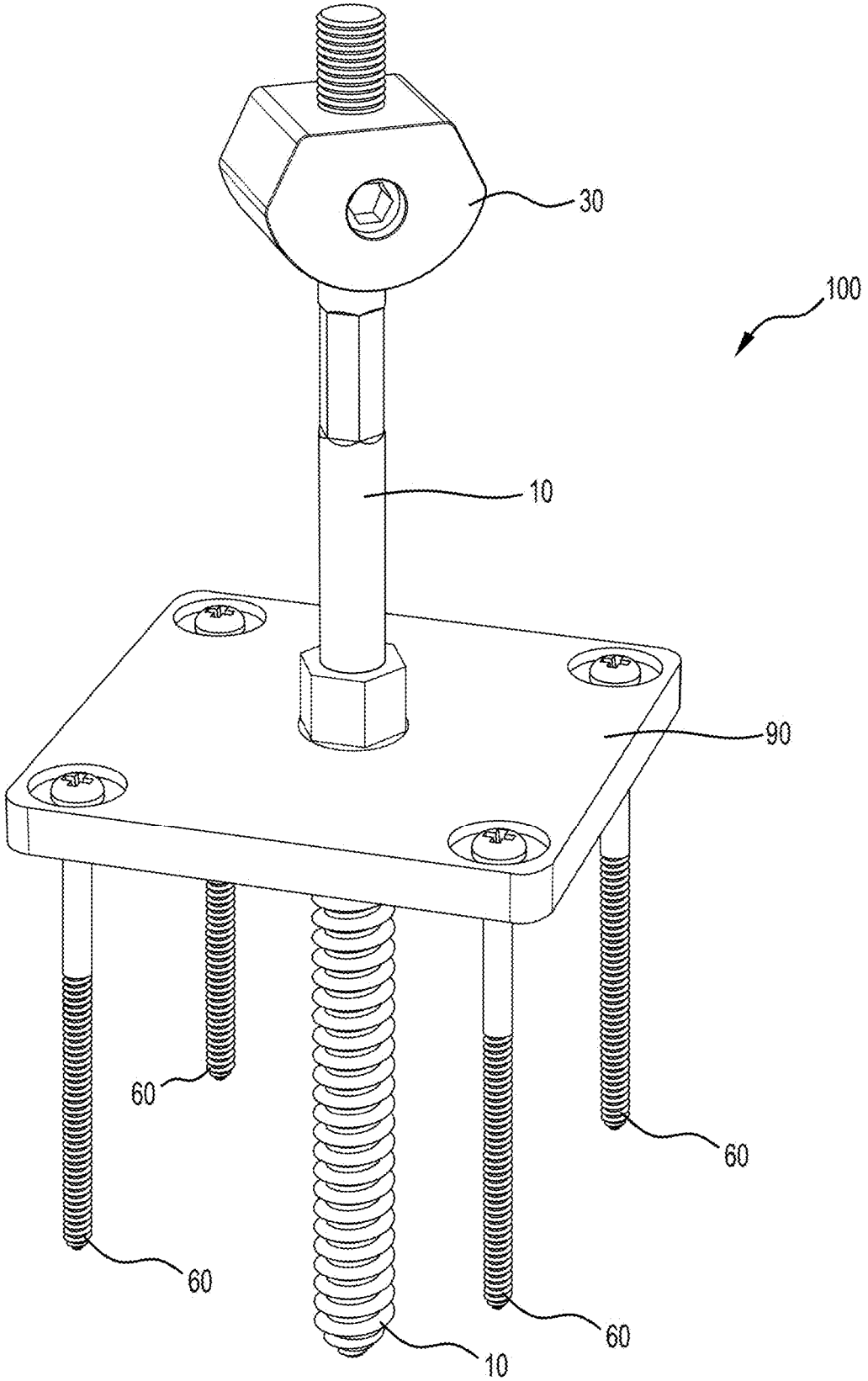
FIG. 7E shows an embodiment of a support of the present invention including the second embodiment of the base plate.

FIG. 7E shows an embodiment of the newel post support 100 that is not engaged with a substrate. The support 100 includes the screw 10, base plate 90, four auxiliary screws 60 and geared nut 30.

Figure 8A:
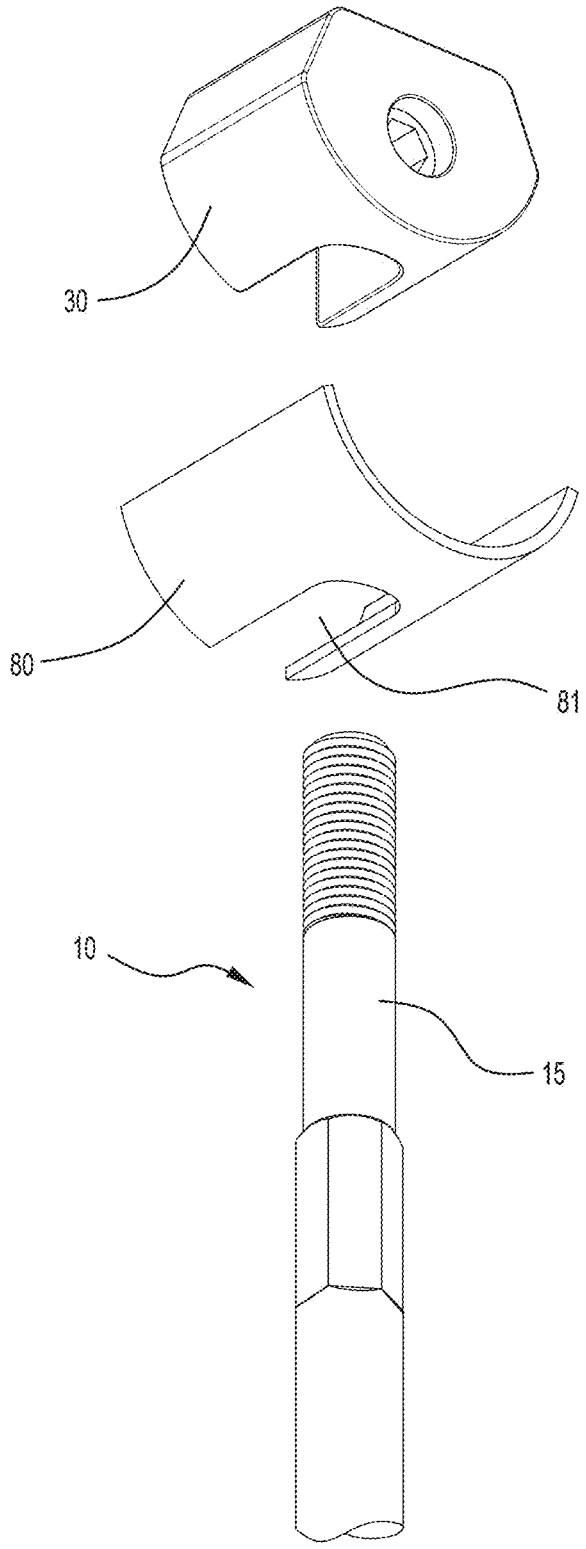
FIGS. 8A, 8B, 8C, 8D, 8E, and 8F illustrate assembling an embodiment of the present invention including a curved washer.
Figure 8B:
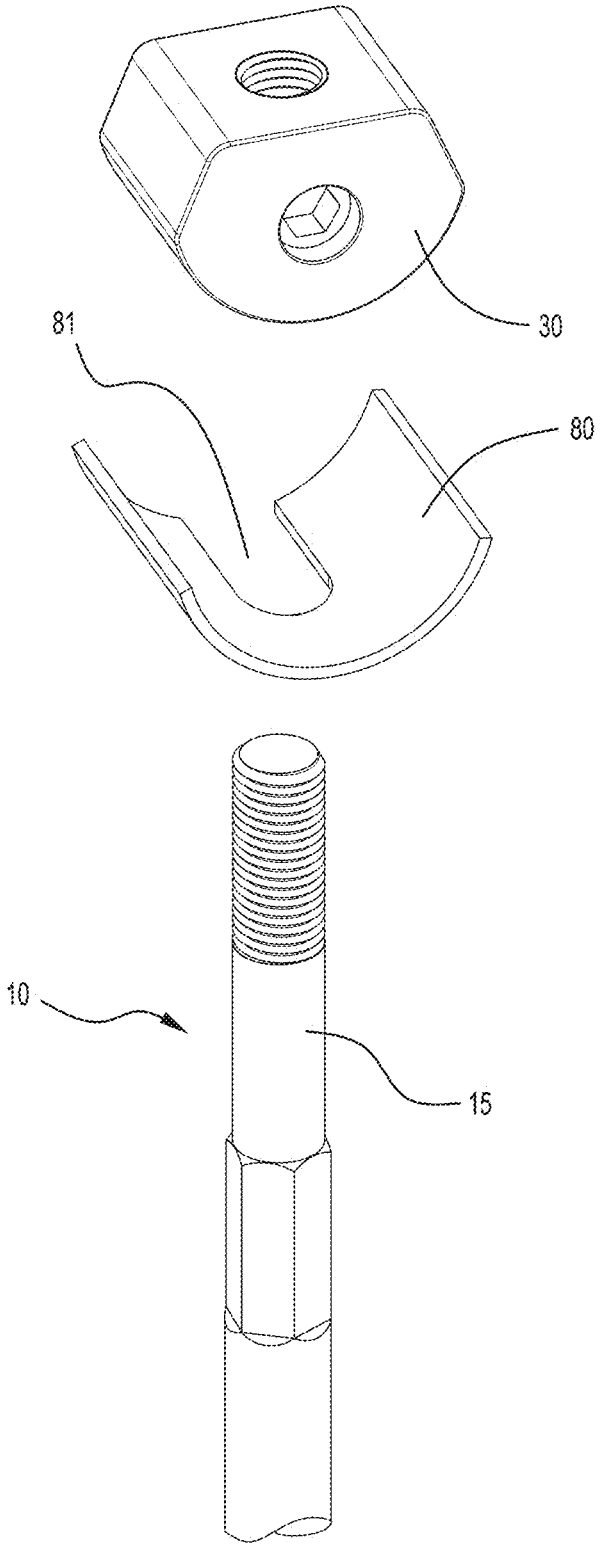
Figure 8C:
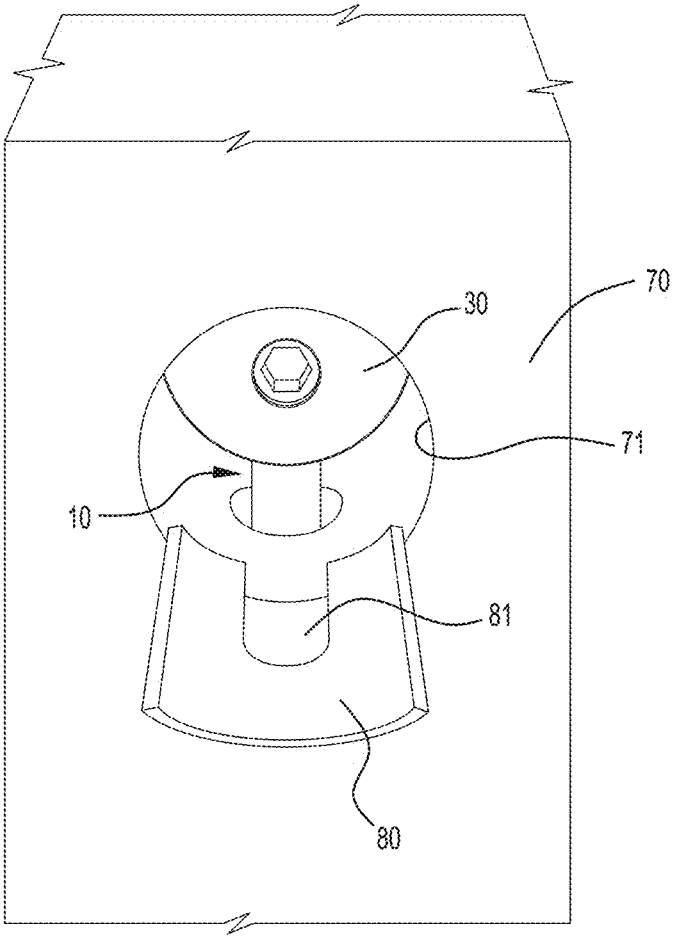
Figure 8D:
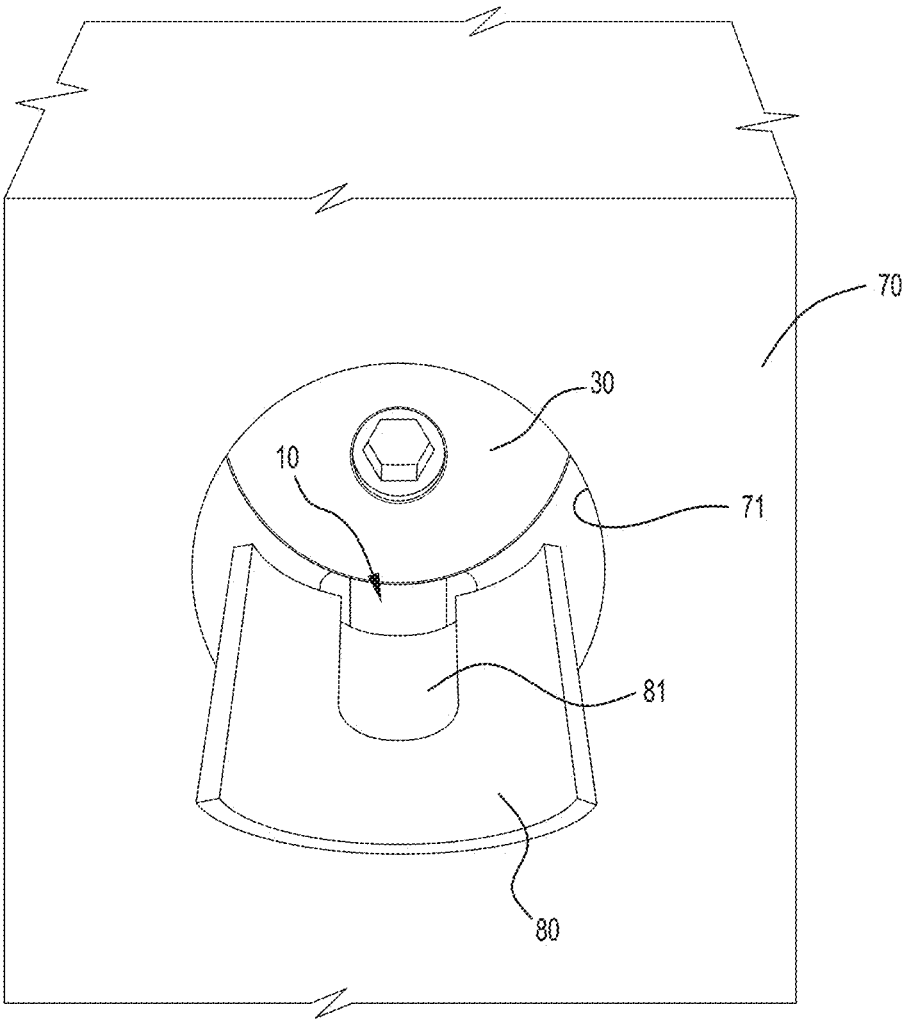
Figure 8E:
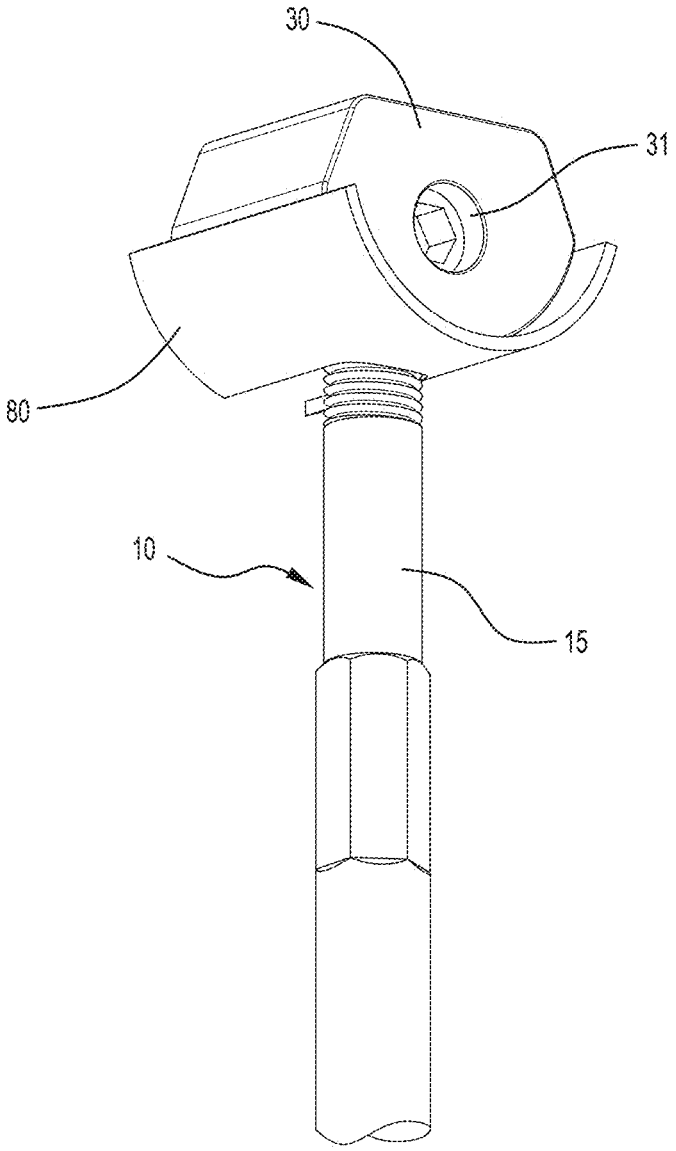
Figure 8F:
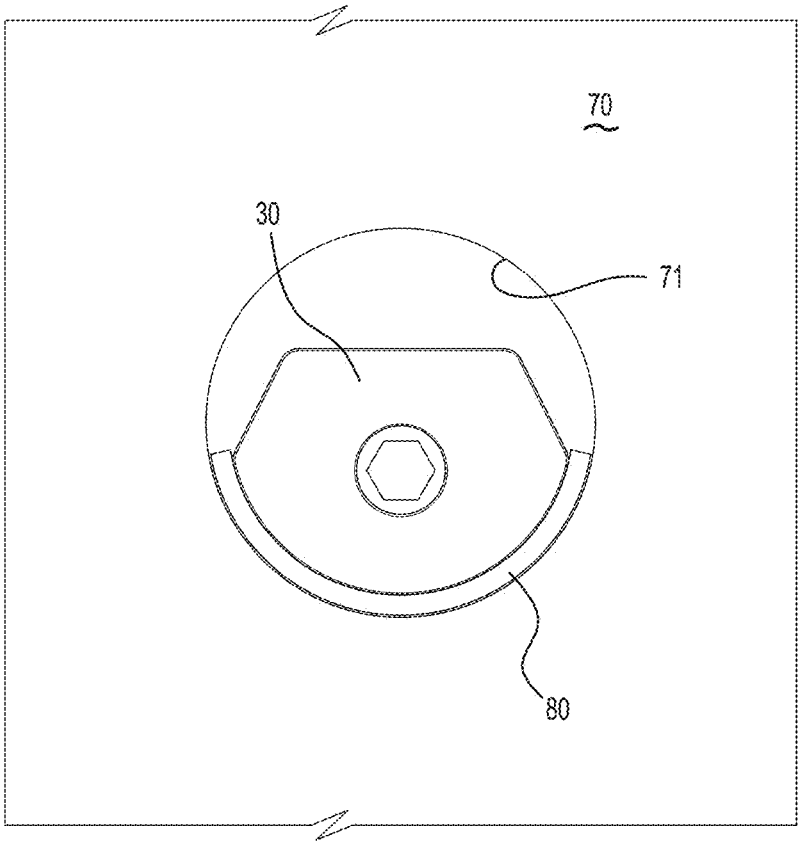

FIGS. 8A to 8F illustrate the use of a curved washer 80. As shown in FIGS. 8A and 8B, the curved washer 80 includes a slot 81 for accommodating the shank 15 of the screw 10. The washer 80 is curved and the slot 81 is formed so as to substantially align with the slot 32 of the nut 30 so that the washer 80 can be positioned underneath the nut 30 as shown in FIGS. 8E and 8F. FIG. 8E shows the positioning of the washer 80 underneath the nut 30 without the newel post 70 being visible, while FIG. 8F shows a view of the washer 80 underneath the nut 30 through the intersecting transverse opening 71 of the newel post 70.

When using the curved washer 80, the newel post can be assembled using the support as illustrated in FIGS. 4A to 4D. However, after the nut 30 is inserted into the intersecting transverse opening 71, but before it is fully screwed onto the second screw thread 12 to apply a loading to the newel post 70 to clamp the lower end against the plate 20, the curved washer is inserted into the intersecting transverse opening 71 so that the end of the screw 10 including the second screw thread 12 and shank 15 is located within the slot 81, as shown in FIGS. 8C and 8D. When the washer 80 is in position, as shown in FIG. 8F, the nut can be screwed onto the second screw thread 12 to apply a loading to the washer 80. The washer 80 then distributes the clamping pressure onto the wood of the newel post. In this way, the washer 80 distributes the clamping force over a larger surface area than would be achieved by using the nut 30 alone. By distributing loading in this way, the washer may reduce or prevent crushing or indentation of the wood of the newel post 70 as the gear housing is tightened. This may prevent or minimize loosening of the clamping of the newel post 70 to the base plate 20 over time, which may otherwise occur if the wood surface in contact with the nut 30 (in the absence of the washer 80) indents over time.

Figure 9:
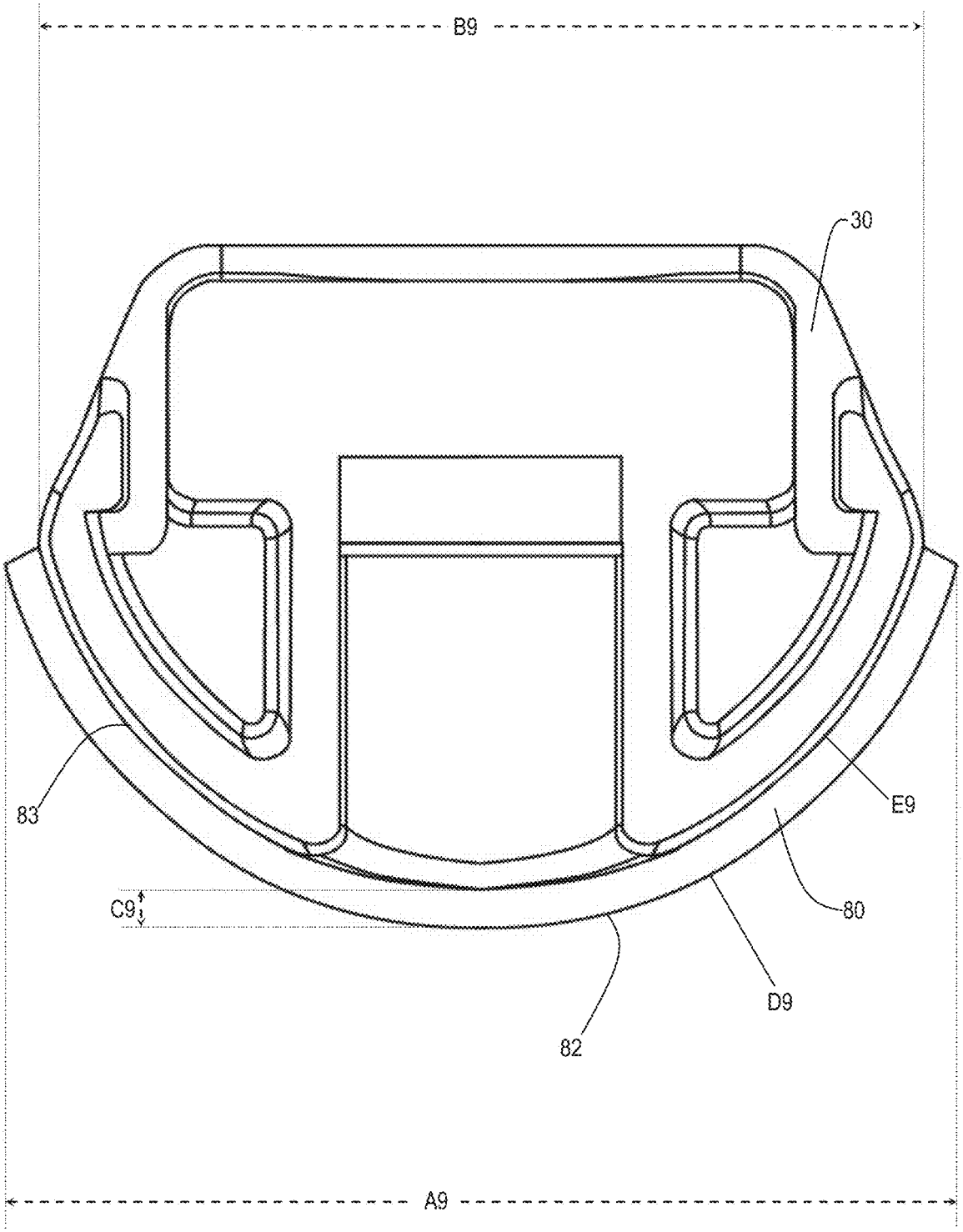
FIG. 9 shows a front view of a geared nut and curved washer.

FIG. 9 illustrates a front view of an embodiment of the curved washer 80 in contact with the geared nut 30. The external width of the washer 80 is 36.78 mm (dimension A9) and the internal width is 34 mm (dimension B9). The external curved surface 82 of the washer 80 has a radius of 19 mm (dimension D9), that is selected to substantially conform to the curved surface of the longitudinal opening in the newel post (not shown). The internal curved surface 83 of the washer 80 has radius of 17.5 mm (dimension E9), that is selected to substantially conform to the curved lower surface of the nut 30. The washer 80 is 1.5 mm thick (dimension C9).

The illustrated embodiment of the curved washer 80 is adapted for use, together with the geared nut 30, in a newel post (not shown) having a circular transverse opening with a diameter of 38 mm.

Throughout this specification and the claims which follow, unless the context requires otherwise, the word "comprise," and variations such as "comprises" and "comprising," will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavor to which this specification relates.

Variations and modifications may be made to the parts previously described without departing from the spirit or ambit of the disclosure.

Moreover, features and aspects of the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A support for a lower end of a newel post, comprising:

a screw having a first screw thread at one end portion, a second screw thread at an opposing end portion and a third screw thread at an intermediate position along the screw; and a base plate having a centrally located threaded hole and auxiliary holes arranged around a periphery of the base plate; wherein the first screw thread is for engaging within a substrate for the newel post;

the third screw thread is adapted to threadedly engage with the centrally located threaded hole to retain the base plate on the screw so that the base plate abuts a surface of the substrate engaged by the first screw thread;

the other end portion of said screw, including the second screw thread, is adapted to pass through the centrally located threaded hole of the base plate;

the opposing end portion of said screw is adapted to extend through a longitudinal passage in the lower end of the newel post and to terminate within an intersecting transverse opening spaced upwardly from the lower end of the newel post so that a nut screwed onto the second screw thread can apply a loading to the newel post to clamp the lower end against the base plate; and the auxiliary holes are for co-operating with auxiliary screws to fasten the base plate to the substrate.

2. The support according to claim 1, wherein the base plate comprises a central spigot through which the centrally located threaded hole passes and including at least one pair of diametrically opposed flat faces adapted to being engaged by a tool to tighten the threaded engagement between the centrally located threaded hole and the third screw thread.

3. The support according to claim 1, wherein the base plate is substantially square with an auxiliary hole in each corner.

4. A support according to claim 1, wherein the screw comprises a shank between the second screw thread and the third screw thread.

5. A support according to claim 4, wherein the shank and the second screw thread each have a diameter smaller than the third screw thread so that the shank and second screw thread are adapted to pass through the centrally located threaded hole of the base plate.

6. A support according to claim 5, wherein the shank includes a section having at least one pair of diametrically opposed flat faces adapted to being engaged by a tool.

7. A support according to claim 4, wherein the shank includes a section having at least one pair of diametrically opposed flat faces adapted to being engaged by a tool.

* * * * *